United States Patent [19]

Ferreira

[11] 4,450,982

[45] May 29, 1984

[54] TOOTHPASTE DISPENSER

[76] Inventor: Americo S. Ferreira, 40 Canoe Place Rd., Apt. #1, Hampton Bays, N.Y. 11946

[21] Appl. No.: 400,626

[22] Filed: Jul. 22, 1982

[51] Int. Cl.[3] ..... B65D 35/24

[52] U.S. Cl. ..... 222/93; 222/99; 222/105

[58] Field of Search ..... 222/92, 93, 95, 98, 222/99, 100, 105, 106, 96

[56] References Cited

U.S. PATENT DOCUMENTS

| | | | |
|---|---|---|---|
| 543,831 | 7/1895 | Klaber | 222/99 X |
| 1,367,916 | 2/1921 | McKieg | 222/100 X |
| 1,590,626 | 7/1925 | Highley | 222/100 X |
| 2,679,951 | 6/1954 | Yantzer | 222/93 X |
| 4,010,871 | 3/1977 | Broadie | 222/93 |

FOREIGN PATENT DOCUMENTS

| | | | |
|---|---|---|---|
| 108353 | 5/1941 | Sweden | 222/100 |

*Primary Examiner*—Joseph J. Rolla
*Assistant Examiner*—L. J. Miller
*Attorney, Agent, or Firm*—Richard L. Miller

[57] ABSTRACT

A toothpaste dispenser having a vertically mounted wall housing containing a dispensable tube whose threaded end is fixed inside a "U" sleeve. The contents of the dispensable tube are discharged by the windup motion of a ratchet that has the tube's lower end attached while an open topped conveyor holds the ratchet biases in a vertically mounted track against a spring. Elements are provided for placement of other necessary toilet articles, such as glasses and toothbrushes.

8 Claims, 4 Drawing Figures

TOOTHPASTE DISPENSER

BACKGROUND OF THE INVENTION

This invention relates to self-contained dental care units but more particularly to a toothpaste dispenser utilizing a ratchet means contained within a sliding open topped conveyor whose combined action discharges the contents of a dispensable tube.

Previously there have been several devices to dispense the contents of disposable dispensable tubes, utilizing a plunger to an electro-magnetic drive carriage. However, they are too costly, too complicated to be of any interest to the domestic market. However, the substitution of a ratchet driven dispenser is less costly and less complicated to construct. As taught in U.S. Pat. No. 3,313,454 wherein the rollers are permanently affixed, which allows no way of compensating for varying tube thicknesses. Furthermore, the casing consists of two parts which are held together by rods, screws and nuts, making it necessary to completely disassemble the device for insertion of the tube. U.S. Pat. No. 4,213,542 teaches friction rollers but however makes no provision for housing of varying lengthed dispensable tubes. Additionally the entire carriage must be removed for insertion of the dispensable tube. U.S. Pat. Nos. 3,172,569 and 3,178,060 are cited for reference. The present invention is a novel and useful dispensable tube dispenser that is useful in homes and the like. Although the tube dispenser of this invention has been primarily designed for the purpose of dispensing toothpaste type dental cream, the dispenser may also be used to dispense other types of creams which are presently marketed in collapsible tubes.

SUMMARY OF THE INVENTION

Accordingly it is an object of the present invention to provide a toothpaste dispenser having a vertically mounted housing containing a handle mounted on its top for ease of transportation. The housing also contains a vertically sliding track which allows for movement of an open topped conveyor while a spring gives resistance of motion.

Another object of the present invention is to provide a toothpaste dispenser whose dispensable tube has its threaded edge engaged in an expandable sleeve in its upper portion while the tube's lower portion is inserted through a slot in the axle of the ratchet mounted to the open topped conveyor.

Still a further object of the present invention is to provide a toothpaste dispenser having a knob attached to the axle of the ratchet whose rotation causes the open topped conveyor to move upward along the vertically sliding track causing the tube's lower end to wrap around the axle and thereby discharge the tube's contents through a sleeve.

Yet still a further object of the present invention is to provide a toothpaste dispenser whose ratchet is mounted on the open topped conveyor. The ratchet contains a slotted axle which passes through the open topped conveyor and has a sprocket gear attached to its end to permit one way rotation, and also contains a pawl having a weight for counterbalancing, and a pivot point for the ratchet operation.

Still a further object of the present invention is to provide a toothpaste dispenser whose housing is hinged at the base end and is pivotally mounted to the rear surface thereby allowing the housing to tilt forward for the insertion of the dispensable tube.

Yet still another object of the present invention is to provide a toothpaste dispenser having a spring loaded door at the outlet end of the sleeve to prevent seepage and contamination of the contents of the dispensable tube.

Still another object of the present invention is to provide a toothpaste dispenser having provisions for placement of other necessary toilet articles, such as a drinking glass, soap, and toothbrushes.

Briefly, in accordance with the present invention there is provided a toothpaste dispenser having a vertically mounted wall housing containing a dispensable tube whose threaded end is fixed inside a "U" sleeve. The contents of the dispensable tube are discharged by the winding motion of a ratchet. The ratchet has the tube's lower end attached to it while the open topped conveyor that holds the ratchet mechanism moves along a vertically mounted track against a spring bias.

Structure is provided for the placement of other necessary articles, such as glasses, soap, and toothbrushes.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWINGS

In the various figures of the drawing, like reference characters designate like parts.

DESCRIPTION OF THE PREFERRED EMBODIMENTS

Figure 1:
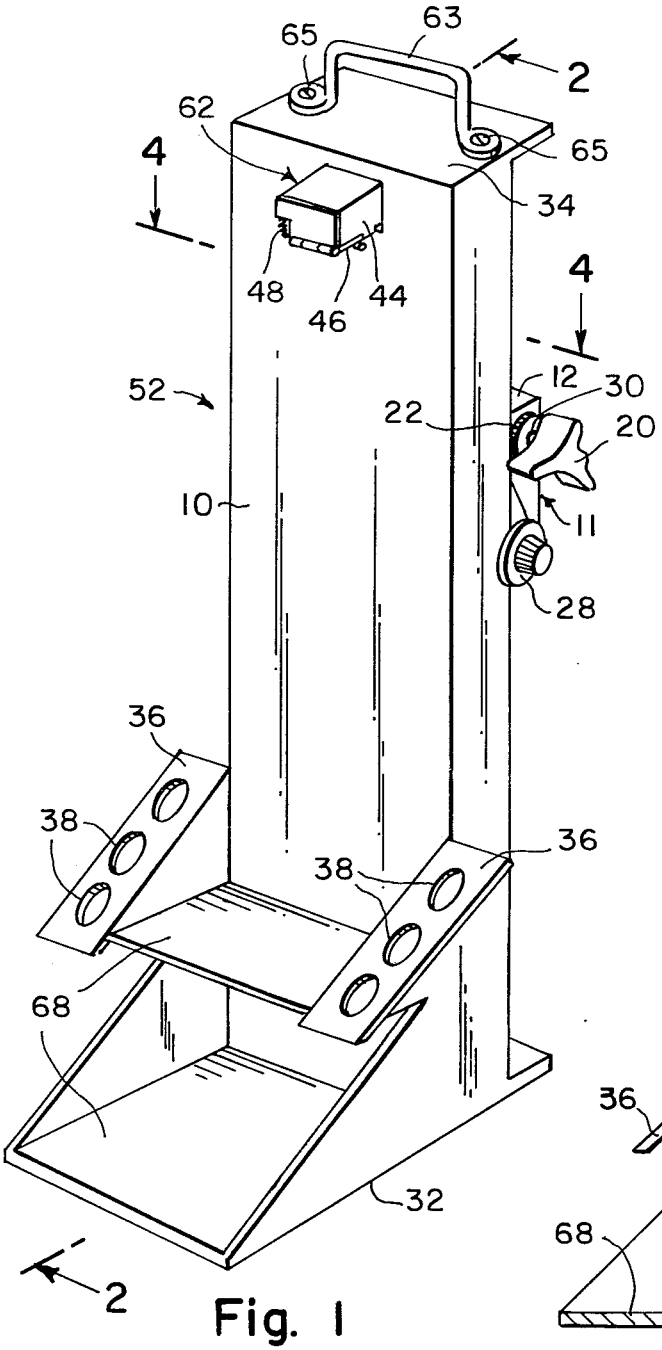
FIG. 1 is a perspective view of the present invention.

Referring now to FIG. 1, the toothpaste dispenser of the present invention is shown generally at 52 and includes an open topped conveyor 12 containing a ratchet mechanism 11.

Figure 2:
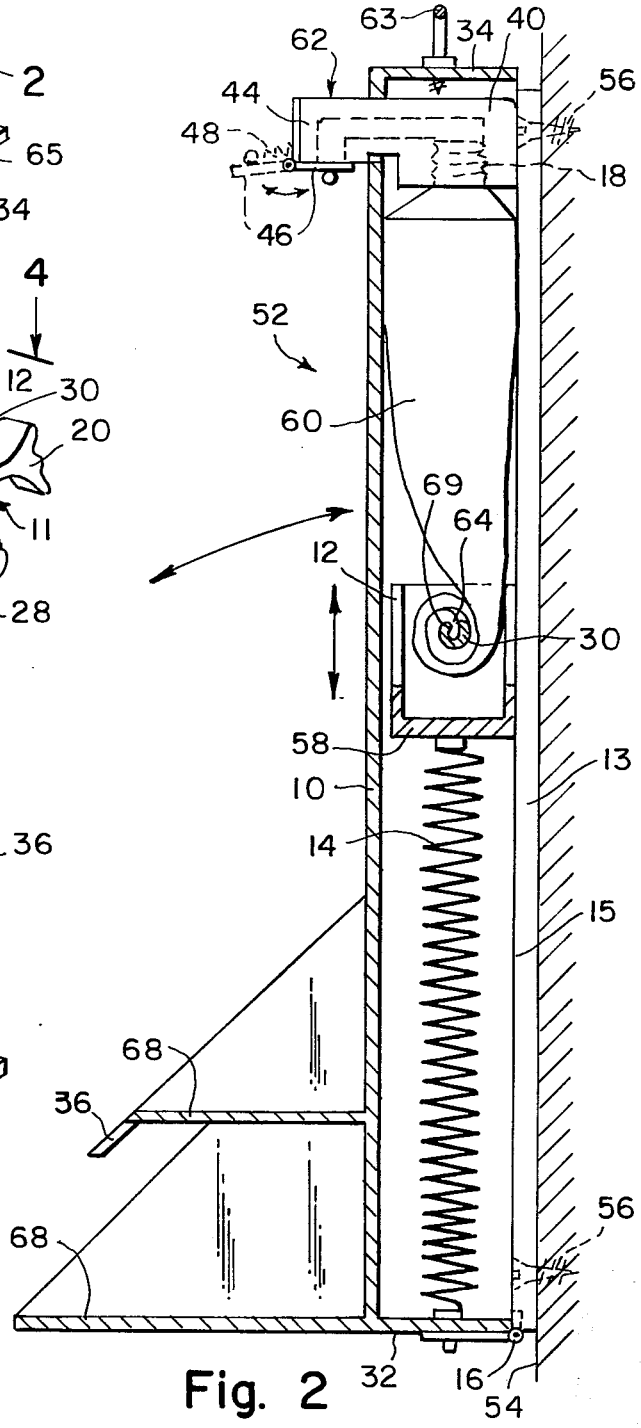
FIG. 2 is a cross sectional view of the present invention taken along line 2—2 of FIG. 1.

As in FIG. 2, the housing 10 of the toothpaste dispenser 52 is vertically mounted to the wall 54 with screws 56. Attached to the rear surface 15 of the housing 10 is a vertically sliding track 13 that allows the open topped conveyor 12 to traverse the length of the housing 10. In order for resistance to be applied to the open topped conveyor 12 as it traverses the vertically sliding track 13, a biasing is provided by a spring 14 which is attached to the bottom surface 58 of the open topped conveyor 12 and the base 32 of the housing 10. The dispensable tube 60 is placed vertically into the housing 10 having its threaded end 18 engaged into the first end 40 of a "U" sleeve. The "U" sleeve 62 acts as a conduit for the contents of the dispensable tube 60. The flat end 64 of the dispensable tube 60 is placed in the open topped conveyor 12 and wrapped around the axle 30 which is part of the ratchet mechanism 11 which is mounted within the open topped conveyor 12.

Figure 3:
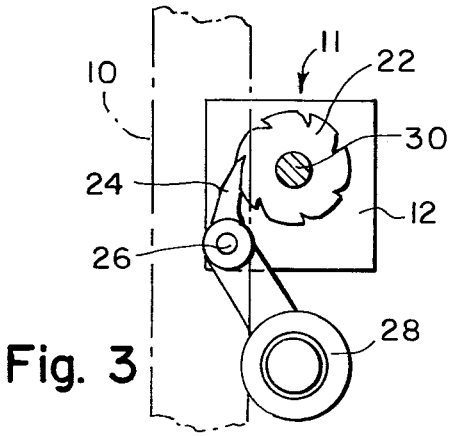
FIG. 3 is a detailed side view of the wind up mechanism of the present invention shown in FIG. 1.

In FIG. 3 the ratchet mechanism 11 contains a sprocket gear 22 which cooperates with the pawl 24 as the counterbalancing weight 28 causes the pawl 24 to pivot at point 26. The ratchet mechanism 11 prevents the lower end 64 of the dispensable tube 60 from unwinding from axle 30 as the contents of the dispensable tube 60 continue to decrease. FIG. 1 shows a knob 20 which manually activates the ratchet mechanism.

As in FIG. 2 the contents of the dispensable tube 60 are squeezed out by the winding motion of ratchet mechanism 11 into the "U" sleeve 62 which terminates at the outlet 44, and into the ambient. A spring 48 biases a door 46 in either an open or closed position as desired, the door 46 being pivotally attached to outlet 44 of the "U" sleeve 62 and thus prevents seepage and contamination of the contents of the dispensable tube 60. To facilitate the loading of the dispensable tube 60, the housing 10 is pivotally mounted at 16 to allow housing 10 to tilt forward from the rear surface 15, exposing its contents and loading mechanism.

In FIG. 1 a handle 63 is fixed with screws 65 to the housing top 34 to provide easier opening of the toothpaste dispenser 52. As a self-contained unit for dental care the toothpaste dispenser 52 contains multiple space platforms 68 that provide for placement of other necessary articles, such as a drinking glass, and soap. In addition, the toothpaste dispenser 52 contains members 36 containing holes 38 that are of a proper size to permit placement of other necessary articles such as toothbrushes, a safety razor, and eyeglasses. The member 36 is disposed skew to the longitudinal axis of the dispensable tube.

Figure 4:
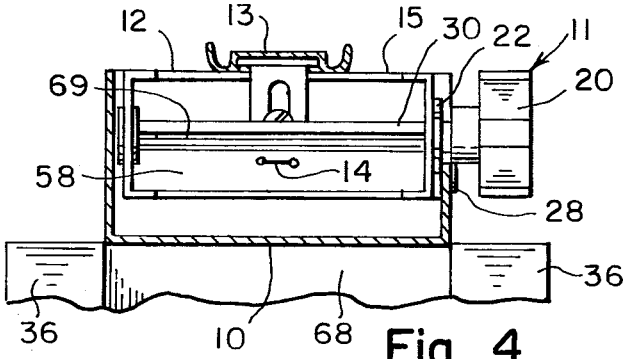
FIG. 4 is a cross sectional view of the present invention taken along line 4—4 of FIG. 1.

As in FIG. 4, the slot 69 in axle 30 provides for insertion of the dispensable tube's lower end 64 for securing purposes as ratchet mechanism 11 is activated.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A toothpaste dispenser comprising:

a housing adapted to be vertically mounted to a wall;

a vertically sliding track located inside of and fixed to the rear surface of said housing;

an open topped conveyor traversing said vertically sliding track;

a biasing means connecting the bottom surface of said open topped conveyor to the base of said housing whereby resistance is provided as said open topped conveyor moves upwardly along and traverses vertically said sliding track;

means for receiving a dispensable tube placed vertically inside said housing, comprising having its threaded end engaged in the first end of a "U" shaped sleeve located in the upper section of said housing while having its lower end engaged around a ratchet means located in said open topped conveyor; and a knob rotatably fixed to said ratchet means whereby its rotation causes said open topped conveyor to traverse upward on said vertically sliding track whereby said lower end of said dispensable tube wraps around said ratchet means, thereby discharging contents of said dispensable tube into said sleeve through an outlet located at second end of said sleeve and into the ambient.

2. A toothpaste dispenser as in claim 1 wherein said biasing means consists of a spring.

3. A toothpaste dispenser as in claim 2 wherein said ratchet means contains an axle rotatably mounted through side surfaces of said open topped conveyor whose longitudinal axis is horizontal and parallel to a wall, a sprocket wheel attached to said axle external to said side surfaces of said open topped conveyor, a pawl pivotally set externally to said side surfaces of said open topped conveyor which engages with said sprocket wheel to permit one way rotation, a weight attached to said pawl for counterbalancing the pawl.

4. A toothpaste dispenser as in claim 3 wherein said base is pivotally connected to said rear surface of said housing whereby said housing can be tilted forward allowing said dispensable tube to be engaged into said first end of said "U" sleeve.

5. A toothpaste dispenser as in claim 4 wherein said second end of said sleeve has a spring loaded door, pivotally attached to prevent seepage and contamination of the contents of said dispensable tube.

6. A toothpaste dispenser as in claim 5 wherein said housing contains a handle secured to its top to aid in tilting said housing.

7. A toothpaste dispenser as in claim 6 wherein said housing contains a plurality of platforms perpendicular to the longitudinal axis of said dispensable tube where various toilet articles may be placed.

8. A toothpaste dispenser as in claim 7 wherein said housing contains a plurality of openings in a member, said member lying in a plane that is skew to said longitudinal axis of said dispensable tube, whereby toothbrush type articles can be held.

* * * * *